United States Patent [19]

Tanno

[11] Patent Number: 4,700,169

[45] Date of Patent: Oct. 13, 1987

[54] ZINC OXIDE VARISTOR AND METHOD OF MAKING IT

[75] Inventor: Yoshikazu Tanno, Kanagawa, Japan

[73] Assignee: Kabushiki Kaisha Toshiba, Japan

[21] Appl. No.: 717,977

[22] Filed: Mar. 29, 1985

[30] Foreign Application Priority Data

Mar. 29, 1984 [JP] Japan ..... 59-59461
Mar. 29, 1984 [JP] Japan ..... 59-59462
Mar. 29, 1984 [JP] Japan ..... 59-59463

[51] Int. Cl.[4] ..... H01C 7/10

[52] U.S. Cl. ..... 338/21; 252/519; 338/308; 427/101; 427/126.6; 427/376.2

[58] Field of Search ..... 252/62.6, 519; 338/21, 338/20, 308; 427/101, 126.3, 126.6, 376.2

[56] References Cited

U.S. PATENT DOCUMENTS

| | | | |
|---|---|---|---|
| 2,258,646 | 10/1941 | Grisdale | 252/519 |
| 2,616,859 | 11/1952 | Verwey | 252/519 |
| 3,162,603 | 12/1964 | Kohn et al. | 252/62.6 |
| 3,813,296 | 5/1974 | McStrack et al. | 338/21 |
| 3,872,582 | 3/1975 | Matsuoka et al. | 29/621 |
| 3,905,006 | 9/1975 | Matsuoka et al. | 338/21 |
| 3,957,673 | 5/1976 | Umezono et al. | 427/419.1 X |
| 4,031,498 | 6/1977 | Hayashi et al. | 338/21 |
| 4,171,328 | 10/1979 | Umemura et al. | 568/479 |

FOREIGN PATENT DOCUMENTS

| | | |
|---|---|---|
| 53-10678 | 4/1978 | Japan . |
| 53-18277 | 6/1978 | Japan . |
| 53-46272 | 12/1978 | Japan . |

OTHER PUBLICATIONS

Ichinose, Noboru and Yuji Yokomizo, "High Performance Ceramic Varistor Element TNR", Toshiba Review, vol. 27, No. 12, Dec. 1972, pp. 1167–1172.

*Primary Examiner*—Arthur T. Grimley
*Assistant Examiner*—Jane K. Lau
*Attorney, Agent, or Firm*—Banner, Birch, McKie & Beckett

[57] ABSTRACT

A high resistivity layer is disclosed for a medal oxide voltage-nonlinear resistor (varistor) for arrestors and surge absorbers of the type having a sintered body containing zinc oxide as a major component and two spaced electrodes attached to the surface of the body wherein the electrodes are insulated from one another by the high resistivity layer. The high resistivity layer of the invention consists essentially of at least zinc ferrate (III). The high resistivity layer is formed by sintering a slurry containing ferric oxide ($Fe_2O_3$) as a major component.

9 Claims, 7 Drawing Figures

ZINC OXIDE VARISTOR AND METHOD OF MAKING IT

BACKGROUND OF THE INVENTION

This invention generally relates to a varistor and, more particularly, relates to a varistor which has two spaced electrodes attached to its surface and insulated from each other by a high resistivity surface layer.

Varistors are extensively used both as arrestors, which conduct unusual and high voltages to the ground in order to protect an electrical system from the voltage, and as surge absorbers, which absorb surge, such as switching surge, because of their highly nonlinear resistance, which varies inversely with the applied voltage. A typical varistor includes a sintered body which contains zinc oxide (ZnO) as a major component and small amounts of one or more additional metal oxides, such as bismuth trioxide ($Bi_2O_3$), antimony trioxide ($Sb_2O_3$), cobalt (III) oxide ($Co_2O_3$), manganese (II) monoxide (MnO) and chromium (III) sesquioxide, ($Cr_2O_3$). A pair of spaced electrodes is provided on the surface of the body. The sintered body is prepared by mixing the additional metal oxide with zinc oxide, granulating the mixture, forming a granulated powder, and sintering. This prior art varistor has a highly nonlinear characteristic compared with the older silicon carbide (SiC) varistor. It is believed that the improvement in the nonlinear characteristic is due to the interface between zinc oxide particles in the sintered body and the boundary layer surrounding the zinc oxide particles. The boundary layer consists of the additional metal oxide. Such a varistor (zinc oxide) also has the property that the nonlinearity may be adjusted to some extent by selecting the kind and amount of additional metal oxide.

The prior art zinc oxide varistor explained above is unsuitable for use as a power arrestor under circumstances in which a high voltage (such as 1 MV) will be applied to it. Specifically, the nonlinear resistance characteristic of such a varistor, which does not have any coating on its surface, is unstable in high ambient humidity because the sintered body of the varistor tends to absorb moisture. Moreover, after a high impulse current flows through the varistor, there is a large change in the resistivity of the varistor. Consequently, a varistor without any coating on its surface is not suitable for use as an overvoltage protection device, such as an arrestor or surge absorber, to which lightning pulses and surge voltage pulses may be applied for a long time.

It is generally required that a varistor have the following characteristics in order to perform satisfactorily as an overvoltage protection device:

(1) The nonlinear resistance characteristic of the varsitor must be unaffected, or hardly affected, by ambient conditions, such as humidity. That is, the varistor should have a stable nonlinear characteristic.

(2) The resistivity value of the varistor must not change, or must change very little, after a high impulse current is applied to it.

(3) The varistor must have an extremely small leakage current flowing on the surface of the sintered body when a high voltage is applied. This property enables the varistor to tolerate a large peak current.

In order to use the zinc oxide varistor as an overvoltage protection device, it has been proposed that the exposed surface of the sintered body be coated with a layer of epoxy resin. However, a varistor with an epoxy resin layer cannot tolerate large peak currents.

It has also been proposed, in U.S. Pat. Nos. 3,872,582, issued Mar. 25, 1975, 3,905,006, issued Sept. 9, 1975, and 4,031,498, issued June 21, 1977, that a high resistivity layer comprising zinc orthosilicate ($Zn_2SiO_4$) and/or zinc antimonate (V) ($Zn_7Sb_2O_{12}$) be provided on the exposed surface of the sintered body. Although a varistor with such a high resistivity layer has both an improved tolerance to large peak currents, and a more stable characteristic in high humidity, compared with the epoxy resin coated varistor, the resistivity stability requirement is not fully satisfied when such a varistor is used as an arrestor.

SUMMARY OF THE INVENTION

It is, therefore, an object of the present invention to provide a varistor with a nonlinear resistance characteristic which is stable under varying ambient conditions (such as high humidity).

It is another object of the invention to provide a varistor with an excellent tolerance to large peak currents.

It is further object of the invention to provide a varistor whose resistivity remains stable after a high impulse current is applied to it.

It is still further an object of the invention to provide a varistor suitable for use as an overvoltage protection device.

The aforementioned objects are achieved in accordance with the present invention by using a high resistivity layer prepared by coating the varistor with a slurry containing ferric oxide ($Fe_2O_3$) as a major component and then sintering the slurry coating. According to one aspect of the invention, the varistor comprises: (a) a sintered body containing zinc oxide as a major component, (b) a high resistivity layer covering a surface of the sintered body and which is prepared by sintering a coating of a slurry containing ferric oxide as a major component, and (c) a pair of spaced electrodes attached to the sintered body. A varistor constructed in accordance with the invention has such stable electrical properties that its resistance value remains unaffected even after a high impulse current is passed through it. Furthermore, the nonlinear resistance characteristic of the varistor represents such an excellent ability to tolerate large peak currents that the varistor is not broken down even by a current of 50 kA, due to the improved high resistance layer.

I have found that the electrical properties of a varistor depend not only upon the composition of the high resistivity layer itself but also upon the composition of the slurry used to form the layer. The variation, with depth, of the concentrations of various components of the high resistivity layer was measured by an X-ray microanalyser, which indicated that more than about 5 mol % of at least one metal oxide, selected from the group consisting of titanium dioxide ($TiO_2$) and ferric oxide, exists at a depth of 10 micrometer from the peripheral (exposed) surface of the high resistivity layer. During preparation of the high resistivity layer bismuth trioxide in the high resistivity layer acts as a solvent so that it promotes diffusion of other metal oxides, such as titanium dioxide, ferric oxide, and antimony trioxide, and reactions between these oxides and zinc oxide. As a result of these reactions, the high resistivity layer includes a high resistivity compound of zinc oxide and these other metal oxides. Consequently, the varistor in accordance with the invention has both an excellent ability to tolerate high peak currents, and a highly stable resistivity, due to the high resistivity layer. Therefore, the varistor of the invention is suitable for use as an overvoltage protection device such as an arrestor or surge absorber.

DETAILED DESCRIPTION OF THE PREFERRED EMBODIMENT

Figure 1:
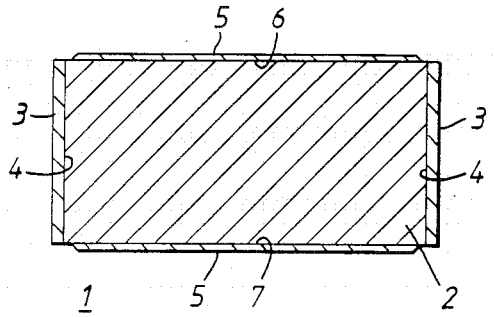
FIG. 1 is a sectional view, in elevation, of the varistor in accordance with the present invention.

FIG. 1 is a sectional view of the preferred embodiment of the invention, a two-terminal device having a voltage-dependent nonlinear resistance (a varistor, or voltage-nonlinear resistor). Varistor 1 comprises sintered body 2, a right circular cylinder 40 mm in diameter and 20 mm in thickness, high resistivity layer 3 covering side surface 4 of cylinder 2, and a pair of electrodes 5, 5 connected to electrode locations at the top end 6 and bottom end 7 of the body, respectively. Sintered body 2 comprises zinc oxide as a major component, 0.5 mol % each of bismuth trioxide, cobalt (III) oxide, manganese (II) monoxide and chromium (III) sesquioxide, and 1.0 mol % each of antimony trioxide and nickel monoxide (NiO). High resistivity layer 3 consists essentially of zinc ferrate (III) ($ZnFe_2O_4$), and is prepared by sintering a coating of slurry containing more than about 50 mol % of ferric oxide and less than about 50 mol % of bismuth trioxide. The thickness of layer 3 is greater than about 10 micrometer preferably 40 to 50 micrometer. Electrodes 5, 5 are made of aluminum.

Varistor 1 is prepared as follows. Starting materials consisting of 0.5 mol % each of bismuth trioxide, cobalt (III) oxide, manganese (II) monoxide and chromium (III) sesquioxide, 1.0 mol % each of anitmony trioxide and nickel monoxide, and the remainder zinc oxide, are mixed in a mixing machine with some amount of water, dispersion material, binder and lubrication material in order to prepare a mixture slurry. (The amounts of water, dispersion material, binder and lubrication material are easily determined by those skilled in the art.) The slurry is granulated by a granulating machine in order to form the slurry into a powder with particles whose mean diameter is, for example, 120 micrometer. The powder is then pressed into a cylinder 50 mm in diameter and 30 mm in thickness. The cylinder is dried at 773 K. in air in order to remove the dispersion material, binder and lubrication material, and then it is calcined at 1293 K.

The cylinder is coated on its side surface with the high-resistivity slurry, using a spray gun, and then it is sintered at a temperature of 1473 K. Finally, the sintered body is provided with a pair of electrodes by abrading both the top and bottom surfaces (to remove the surface of the cylinder at both top and bottom) and then spraying them with aluminum. The purpose of abrading the cylinder is that good contact between the electrode and the cylinder should be realized. If the electrode is attached to the top or bottom of the cylinder without abrading or polishin up, an electrical barrier occurs between them. Then, the non-linearity of the varistor is reduced. This abrading treatment is knon by those skilled in the art.

The slurry for the high resistivity layer is prepared by mixing predetermined amounts of bismuth trioxide and ferric oxide with a quantity of pure water equal in weight to the sum of the weights of the ferric oxide and bismuth trioxide. If a binder, such as about 0.1 wt % of polyvinyl alcohol, is added to the slurry, the mechanical strength of the high resistivity layer may increase.

In order to evaluate their electrical characteristics, I constructed varistors having high resistivity layers made from a slurry whose ferric oxide composition varied from 100 to 0 mol % and whose bismuth trioxide composition correspondingly varied from 0 to 100 mol %. The results of the peak current tolerance test (current impulse withstand characteristics) and resistivity stability test are shown in FIGS. 2 and 3, respectively.

The peak current tolerance test is carried out by twice applying a current pulse of $4\times10$ microsecond to the varistor electrodes. (A $4\times10$ microsecond pulse means a pulse whose current value increases to 90% of its maximum value after 4 us but decreases to 50% of its maximum value after 10 microsecond, while it continuously increases from zero to the maximum and then continuously decreases from the maximum to zero.) The peak current in FIG. 2 means such a maximum current value of the $4\times10$ microsecond pulse that the high resistivity layer is not broken down after the test.

Figure 2:
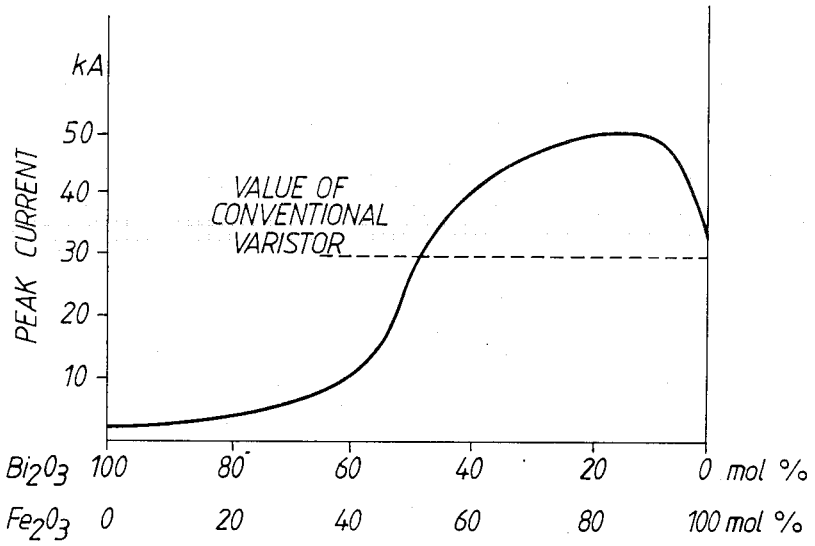
FIG. 2 is a graph of the relationship between the relative amounts of ferric oxide and bismuth trioxide in the slurry for the high resistivity layer, and the peak current which the resulting varistor is above to tolerate.
Figure 3:
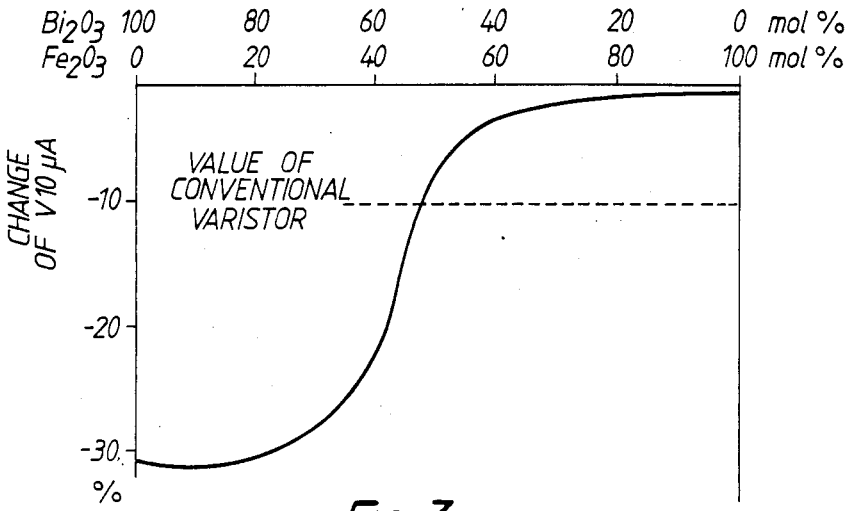
FIG. 3 is a graph of the relationship between the relative amounts of ferric oxide and bismuth trioxide in the slurry for the high resistivity layer, and the change in resistivity of the resulting varistor after a high impulse current is applied to it.

As seen from FIG. 2, the high resistivity layer prepared by sintering a coating of slurry containing more than about 50 mol % of ferric oxide and less than about 50 mol % of bismuth trioxide has an excellent peak current tolerance compared with the conventional high resistivity layer (consisting of silicon dioxide ($SiO_2$), antimony trioxide and zinc oxide). Namely, the high resistivity layer of the invention does not break down at 50 kA, but the conventional high resistivity layer does break down at about 30 kA.

The resistivity stability test is carried out by first applying twenty $8\times20$ microsecond pulses, with peak values of 10 kA, to the varistor, and then measuring the voltage ($V_{10}$) microampere required to produce a 10 uA reverse current (opposite in direction to the 10 kA pulses). This voltage is compared with the corresponding voltage measured before application of the pulses, and the fractional change is noted. (The 8×20 microsecond pulses are similar to the 4×10 microsecond pulses explained above.)

As seen from FIG. 3, the high resistivity layer in accordance with the invention has a much more stable resistivity, compared with the conventional high resistivity layer consisting of silicon dioxide, antimony trioxide, and zinc oxide. Namely, the fractional change of $V_{10}$ microampere is less than −5% when the varistor is constructed in accordance with the invention, but with a conventional varistor, the value is −10%.

As the result of measurements using an X-ray microanalyser, I found that more than 10 mol % of ferric oxide exists at a depth of 10 micrometer from the peripheral surface of the high resistivity layer. In view of the measurement result, it is understood that the high resistivity layer of this embodiment is composed of a compound of zinc oxide diffusing from the sintered body and ferric oxide contained in the slurry. Namely, it is understood that the high resistivity layer is composed of zinc ferrate (III).

In connection with FIGS. 4 and 5, another embodiment of the invention will be explained. This embodiment of the varistor has a structure the same as that shown in FIG. 1, but the compositions of the high resistivity layer and the sintered body are changed. The sintered body, which is a right circular cylinder having a diameter of 32 mm and a thickness of 30 mm, consists primarily of zinc oxide, with 0.5 to 5 mol % each of bismuth trioxide, cobalt (III) oxide, manganese (II) monoxide, antimony trioxide, and nickel monoxide. The high resistivity layer essentially consists of zinc ferrate (III) and zinc titanate (IV) ($Zn_2TiO_4$). The varistor is prepared by using metal oxides, but other metal compounds, such as hydroxides, carbonates or oxalates, which can be changed into metal oxides by sintering, may be used. Furthermore, the varistor may have a protecting layer of glass on the peripheral surface of the high resistivity layer in order to improve its characteristics in high humidity and its peak current tolerance. The high resistivity layer is prepared by sintering a coating of slurry containing about 50 to 95 mol % of ferric oxide, about 5 to 50 mol % of titanium dioxide, and about 0.3 to 20 mol % of bismuth trioxide.

The varistor in accordance with this second embodiment is prepared as follows. A starting material consisting of 0.5 to 5 mol % each of bismuth trioxide, cobalt (III) oxide, manganese (II) monoxide, antimony trioxide and nickel monoxide, and the remainder zinc oxide, is mixed in a mixing machine with some amount of water, dispersion material, binder and lubrication material in order to prepare a mixture slurry. The slurry is granulated by a spray drier in order to form a powder with particles whose mean diameter is, for example, 120 micrometer. The powder is pressed into a cylinder 40 mm in diameter and 40 mm in thickness, then dried at 773 K. in air in order to remove the dispersion material, binder and lubrication material. It is then calcined at 1293 K.

The disk is coated with the high resistivity slurry using a spray gun, and then it is sintered at a temperature of 1323 to 1573 K. Finally, the sintered body is provided with a pair of aluminum electrodes on both its abraded top and bottom faces.

The high resistivity slurry is prepared by mixing predetermined amounts of bismuth trioxide, ferric oxide and titanium dioxide with an amount of water by weight equal to the total amount of ferric oxide, bismuth trioxide and titanium dioxide by weight. If a binder, such as about 0.1 wt % of polyvinyl alcohol, is added to the slurry, the mechanical strength of the high resistivity layer may increase.

In order to evaluate electrical characteristics, the high resistivity layer slurries shown in Table 1 were prepared, and the resulting varistors were tested by means of the peak current tolerance test and the resistivity stability test.

TABLE 1

| | Composition of slurry of High Resistivity Layer (mol %) | | | Peak Current Tolerance | Resistivity Stability (Change of $V_{10}$ μA) |
|---|---|---|---|---|---|
| | $Bi_2O_3$ | $Fe_2O_3$ | $TiO_2$ | | |
| Example: | | | | | |
| 1 | 0.3 | 92.5 | 7.2 | 45 (kA) | −1.3 (%) |
| 2 | " | 90.0 | 9.7 | 50 | −1.0 |
| 3 | " | 80.0 | 19.7 | 50 | −1.1 |
| 4 | " | 70.0 | 29.7 | 50 | −1.4 |
| 5 | " | 60.0 | 39.7 | 50 | −1.7 |
| 6 | " | 50.0 | 49.7 | 45 | −1.3 |
| 7 | 1.0 | 90.0 | 9.0 | 50 | −0.8 |
| 8 | " | 80.0 | 19.0 | 65 | −0.5 |
| 9 | " | 70.0 | 29.0 | 65 | −0.6 |
| 10 | " | 60.0 | 39.0 | 60 | −0.4 |
| 11 | " | 50.0 | 49.0 | 55 | −0.3 |
| 12 | 5.0 | 90.0 | 5.0 | 70 | −0.2 |
| 13 | " | 75.0 | 20.0 | 75 | −0.2 |
| 14 | " | 50.0 | 45.0 | 50 | −0.3 |
| 15 | 10.0 | 85.0 | 5.0 | 80 | −0.1 |
| 16 | " | 67.5 | 22.5 | 85 | 0 |
| 17 | " | 50.0 | 40.0 | 65 | −0.2 |
| 18 | 15.0 | 80.0 | 5.0 | 70 | −0.4 |
| 19 | " | 65.0 | 20.0 | 80 | −0.3 |
| 20 | " | 50.0 | 35.0 | 75 | −0.5 |
| 21 | 20.0 | 75.0 | 5.0 | 50 | −1.3 |
| 22 | " | 62.5 | 17.5 | 60 | −1.0 |
| 23 | " | 50.0 | 30.5 | 60 | −1.1 |
| Comparison: | | | | | |
| 1 | 0 | 95.0 | 5.0 | 30 | −1.7 |
| 2 | " | 50.0 | 50.0 | 35 | −1.6 |
| 3 | 30.0 | 60.0 | 10.0 | 30 | −3.0 |
| 4 | " | 50.0 | 20.0 | 35 | −3.1 |
| 5 | " | 30.0 | 40.0 | 20 | −3.2 |
| 6 | Withhout High Resistivity Layer | | | 2 | — |
| 7 | With Epoxy Resin Layer | | | 10 | Broken down by 5 times |
| 8 | $Zn_7Sb_2O_{12}/Zn_2SiO_4$ = 0.25 | | | 65 | −4.5 |

Figure 4:
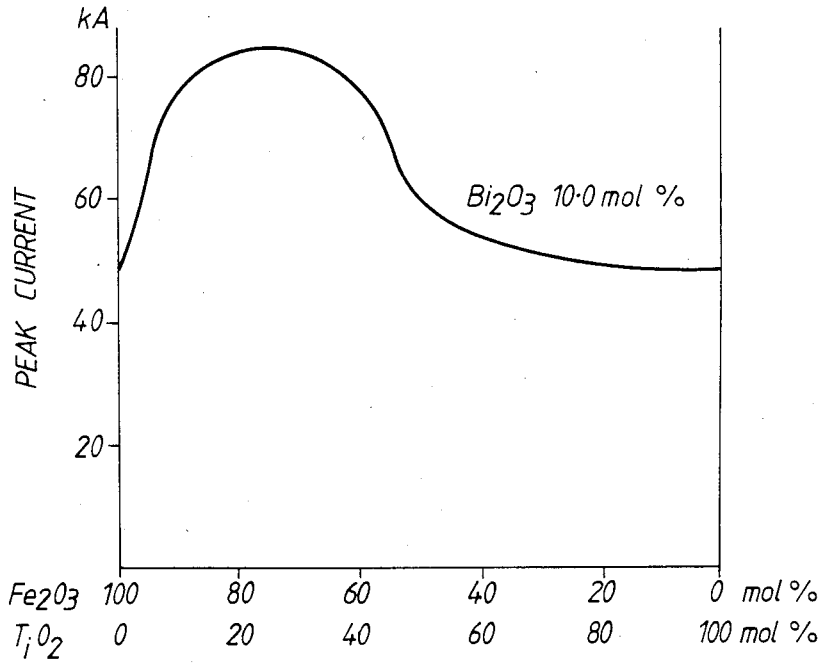
FIG. 4 is a graph of the relationship between the relative amounts of ferric oxide and titanium dioxide in the slurry for the high resistivity layer, and the peak current which the resulting varistor is able to tolerate.
Figure 5:
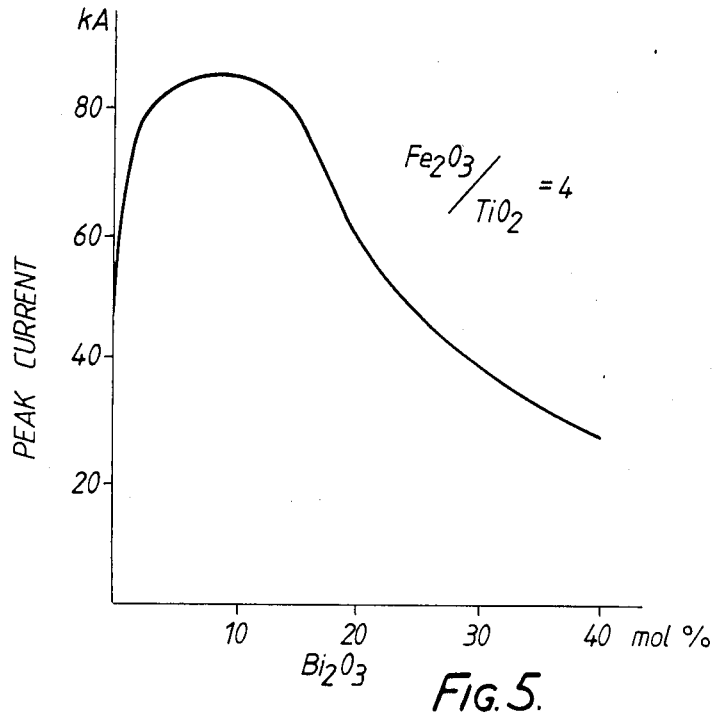
FIG. 5 is a graph of the relationship between the amount of bismuth trioxide in the slurry for the high resistivity layer, and the peak current which the resulting varistor is able to tolerate, when titanium dioxide is included in the slurry.

The results of these tests are listed in Table 1 and diagrammed in FIGS. 4 and 5. FIG. 4 shows the relationship between the relative amounts of ferric oxide and titanium dioxide in the slurry and the current tolerance of the resulting varistor, when the amount of bismuth trioxide in the slurry is 10 mol %. FIG. 5 also shows current tolerance, in this case as a function of varying amounts of bismuth trioxide, when the ratio of ferric oxide to titanium dioxide is maintained at 4.

As seen from Table 1, the comparison varistors (No. 6 and No. 7), which have, respectively, no high resistivity layer and a layer made of epoxy resin, are broken down by current impulses of 10 kA or less; but the varistors in accordance with the invention have excellent current tolerance characteristics. In addition, although varistors with conventional high resistivity layers consisting of zinc antimonate (V) and zinc orthosilicate (shown as Comparison No. 8), of which the ratio of the antimonate to the silicate is 0.25, have good current tolerance for practical use, their resistivity varies so much (the change of $V_{10}$ microampere is so large) that they are unsatisfactory for the intended uses of the varistor.

As shown in Table 1 and FIGS. 4 and 5, the slurry for the high resistivity layer contains 50 to 95 mol % of ferric oxide, 5 to 50 mol % of titanium dioxide and 0.3 to 20 mol % of bismuth trioxide. If the composition of the slurry exceeds these limits, the varistor will not have the desired electrical characteristics.

As the result of measurements made using an X-ray microanalyser, I found that more than 5 mol % of ferric oxide and more than 1 mol % of titanium dioxide exist at a depth of 10 micrometer from the peripheral surface of the high resistivity layer. In view of the measurement result, it is understood that the high resistivity layer of the embodiment is composed of a compound of zinc oxide diffusing from the sintered body and ferric oxide contained in the slurry and a compound of zinc oxide diffusing from the sintered body and titanium dioxide contained in the slurry. Namely, it is understood that the high resistivity layer is composed of zinc ferrate (III) and zinc titanate (IV).

Figure 6:
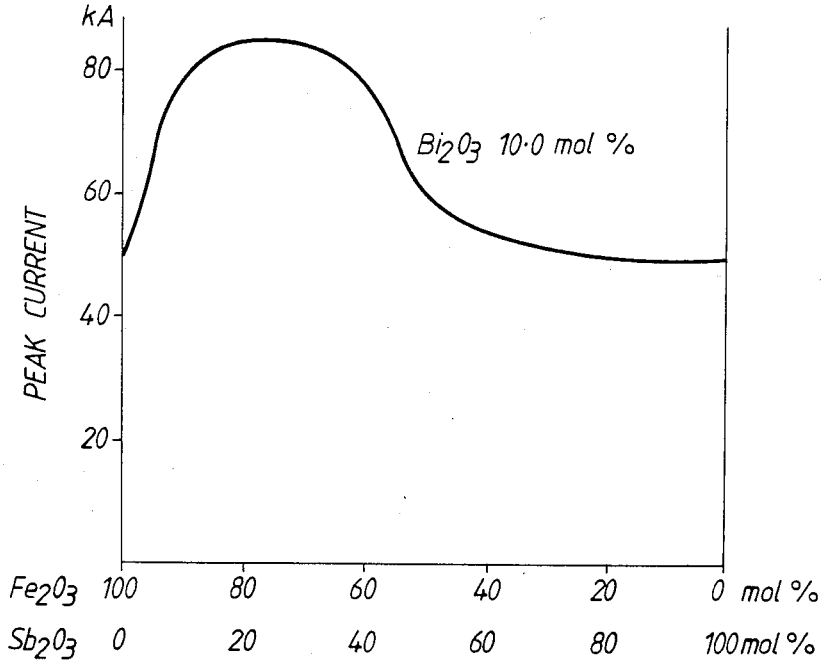
FIG. 6 is a graph of the relationship between the relative amounts of ferric oxide and antimony trioxide in the slurry for the high resistivity layer, and the peak current which the resulting varistor is able to tolerate.
Figure 7:
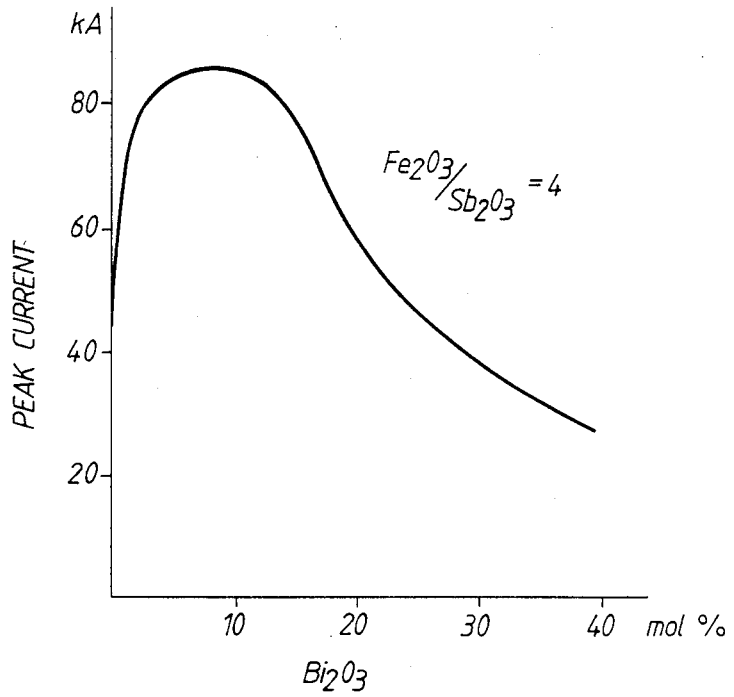
FIG. 7 is a graph of the relationship between the amount of bismuth trioxide in the slurry for the high resistivity layer, and the peak current which the resulting varistor is able to tolerate, when antimony trioxide is included in the slurry.

Referring to FIGS. 6 and 7, another embodiment is explained. This varistor has a structure the same as that of the previous embodiment. The composition of the high resistivity layer, however, is different. The layer essentially consists of zinc ferrate (III) and zinc antimonate (V), and is prepared by sintering a coating of slurry containing 50 to 95 mol % of ferric oxide, 5 to 50 mol % of antimony trioxide and 0.3 to 20 mol % of bismuth trioxide. Since the varistor in accordance with this embodiment is prepared in same manner described above, an explanation of its construction and preparation is omitted.

In order to evaluate electrical characteristics, the high resistivity layer slurries shown in Table 2 were prepared, and the resulting varistors tested by means of the peak current tolerance test and the resistivity stability test.

TABLE 2

| | Composition of slurry of High Resistivity Layer (mol %) | | | Peak Current Tolerance | Resistivity Stability (Change of $V_{10}$ μA) |
|---|---|---|---|---|---|
| | $Bi_2O_3$ | $Fe_2O_3$ | $Sb_2O_3$ | | |
| Example: | | | | | |
| 24 | 0.3 | 92.5 | 7.2 | 40 (kA) | −1.2 (%) |
| 25 | " | 90.0 | 9.7 | 50 | −0.9 |
| 26 | " | 80.0 | 19.7 | 50 | −1.0 |
| 27 | " | 70.0 | 29.7 | 50 | −1.3 |
| 28 | " | 60.0 | 39.7 | 55 | −1.5 |
| 29 | " | 50.0 | 49.7 | 45 | −1.3 |
| 30 | 1.0 | 90.0 | 9.0 | 50 | −0.9 |
| 31 | " | 80.0 | 19.0 | 70 | −0.4 |
| 32 | " | 70.0 | 29.0 | 65 | −0.7 |
| 33 | " | 60.0 | 39.0 | 60 | −0.5 |
| 34 | " | 50.0 | 49.0 | 55 | −0.4 |
| 35 | 5.0 | 90.0 | 5.0 | 70 | −0.2 |
| 36 | " | 75.0 | 20.0 | 75 | −0.1 |
| 37 | " | 50.0 | 45.0 | 50 | −0.3 |
| 38 | 10.0 | 85.0 | 5.0 | 85 | −0.2 |
| 39 | " | 67.5 | 22.5 | 90 | −0.1 |
| 40 | " | 50.0 | 40.0 | 70 | −0.1 |
| 41 | 15.0 | 80.0 | 5.0 | 70 | −0.3 |
| 42 | " | 65.0 | 20.0 | 85 | −0.4 |
| 43 | " | 50.0 | 35.0 | 75 | −0.4 |
| 44 | 20.0 | 75.0 | 5.0 | 50 | −1.2 |
| 45 | " | 62.5 | 17.5 | 65 | −0.9 |
| 46 | " | 50.0 | 30.0 | 60 | −1.0 |
| Comparison: | | | | | |
| 9 | 0 | 95.0 | 5.0 | 30 | −1.5 |
| 10 | " | 50.0 | 50.0 | 40 | −1.7 |
| 11 | 30.0 | 60.0 | 10.0 | 30 | −3.3 |
| 12 | " | 50.0 | 20.0 | 35 | −2.9 |
| 13 | " | 30.0 | 40.0 | 20 | −3.4 |
| 6 | Without High Resistivity Layer | | | 2 | — |
| 7 | With Epoxy Resin Layer | | | 10 | Broken down by 5 times |
| 8 | $Zn_7Sb_2O_{12}/Zn_2SiO_4$ = 0.25 | | | 65 | −4.5 |

The results of these tests are listed in Table 2 and diagrammed in FIGS. 6 and 7. FIG. 6 shows the current tolerance as a result of varying the amounts of ferric oxide and antimony trioxide in the slurry when the amount of bismuth trioxide is 10 mol %. FIG. 7 also shows current tolerance, in this case as a result of varying the amount of bismuth trioxide, when the ratio of ferric oxide to antimony trioxide is maintained at 4.

As seen from Table 2, the comparison varistors (No. 6 and No. 7), which have, respectively, no high resistivity layer and a layer made of epoxy resin, are broken down by current impulses of 10 kA or less; but the varistors in accordance with the invention have excellent current tolerance characteristics. In addition, although varistors with conventional high resistivity layers consisting of zinc antimonate (V) zinc orthosilicate (shown as Comparison No. 8), of which the ratio of the antimonate to the silicate is 0.25, have good current tolerance for practical use, their resistivity varies so much (the change of $V_{10}$ microampere is so large) that they are unsatisfactory for the intended uses of the varistor.

As shown in Table 2 and FIGS. 6 and 7, the slurry for the high resistivity layer essentially consists of 50 to 95 mol % of ferric oxide, 5 to 50 mol % of antimony trioxide and 0.3 to 20 mol % of bismuth trioxide. If the composition of the slurry exceeds these limits, the varistor will not have the desired electrical characteristics.

As the result of measurements made using an X-ray microanalyser, I found that more than 5 mol % of ferric oxide and more than 1 mol % of antimony trioxide exist at a depth of 10 micrometer from the peripheral surface of the high resistivity layer. In view of the measurement result, it is understood that the high resistivity layer of the embodiment is composed of a compound of zinc oxide diffusing from the sintered body and ferric oxide contained in the slurry and a compound of zinc oxide diffusing from the sintered body and antimony trioxide contained in the slurry. Namely, it is understood that the high resistivity layer is composed of zinc ferrate (III) and zinc antimonate (IV).

Although illustrative embodiments of the present invention have been described in detail with reference to the accompanying drawings, it is to be understood that the invention is not limited to those precise embodiments, and that various changes and modifications may be effected therein by one skilled in the art without departing from the scope or spirit of the invention.

I claim:

1. A voltage-nonlinear resistor comprising:

a sintered body containing zinc oxide as a major component and having a surface;

a high resistivity layer on said surface, said high resistivity layer being formed by sintering a coating of slurry on said surface, said slurry containing ferric oxide as a major component; and a pair of spaced electrodes attached to said surface and insulated from each other by said high resistivity layer.

2. A voltage-nonlinear resistor according to claim 1 wherein said slurry further comprises:

bismuth trioxide; and at least one compound selected from the group consisting of titanium dioxide and antimony trioxide.

3. A voltage-nonlinear resistor according to claim 2 wherein the approximate proportions of slurry ingredients are as follows:

ferric oxide—50 to 95 mol %;

bismuth trioxide—0.3 to 20 mol %; and one compound selected from the group consisting of titanium dioxide and antimony trioxide—5 to 50 mol %.

4. A voltage-nonliner resistor comprising:

a sintered body containing zinc oxide as a major component and having a surface;

a high resistivity layer on said surface, said high resistivity layer consisting essentially of zinc ferrate (III); and a pair of spaced electrodes attached to said surface and insulated from each other by said high resistivity layer.

5. A method of making a varistor having a sintered body, a pair of spaced electrodes attached to electrode locations on a surface of the body, and a high resistivity layer on the surface between the electrodes, said method comprising the steps of:

forming the body primarily of zinc oxide;

forming a slurry comprising ferric oxide;

depositing the slurry on the surface between the electrode locations;

sintering the slurry; and attaching the electrodes to the electrode locations.

6. The method of claim 5 wherein the slurry further comprises:

bismuth trioxide; and at least one compound selected from the group consisting of titanium dioxide and antimony trioxide.

7. The method of claim 6 wherein the approximate proportions of the slurry ingredients are as follows:

ferric oxide—50 to 90 mol % bismuth trioxide—0.3 to 20 mol %; and at least one compound selected from the group consisting of titanium dioxide and antimony trioxide—5 to 50 mol %.

8. A voltage-nonlinear resistor comprising:

a sintered body containing zinc oxide as a major component and having a surface;

a high resistivity layer on said surface, said high resistivity layer consisting essentially of zinc ferrate (III) and at least one compound selected from the group consisting of zinc titanate (IV) and zinc antimonate (V); and a pair of spaced electrodes attached to said surface and insulated from each other by said high resistivity layer.

9. A voltage-nonlinear resistor according to claim 8 wherein said high resistivity layer contains, at a depth of 10 um from a peripheral surface of said layer, not less than 5 mol % of ferric oxide and not less than 1 mol % of at least one compound selected from the group consisting of titanium dioxide and antimony trioxide.

* * * * *